United States Patent [19]

Larson

[11] 4,314,114

[45] Feb. 2, 1982

[54] LAMINATED MEMBRANE SWITCH

[75] Inventor: Willis A. Larson, Crystal Lake, Ill.

[73] Assignee: Oak Industries, Rancho Bernardo, Calif.

[21] Appl. No.: 118,410

[22] Filed: Feb. 4, 1980

[51] Int. Cl.[3] ..... H01H 13/02

[52] U.S. Cl. ..... 200/5 A; 29/622; 200/159 B

[58] Field of Search ..... 200/5 R, 5 A, 159 B, 200/292; 29/622

[56] References Cited

U.S. PATENT DOCUMENTS 4,066,851 1/1978 White et al. ..... 200/340 X

*Primary Examiner*—J. V. Truhe

*Assistant Examiner*—Morris Ginsburg

*Attorney, Agent, or Firm*—Kinzer, Plyer, Dorn & McEachran

[57] ABSTRACT

An assembly for manufacture of a membrane switch includes a composite formed of first and second layers, one substantially thicker than the other, with the composite having a size and shape to form both outer members of a membrane switch when folded back upon itself. Metallic conductors, preferably silver, are formed on the composite prior to folding. A spacer member having spaced openings therein and extending over approximately half of the area of the composite is positioned thereupon. After the composite is folded over the spacer member, laminating heat and pressure are applied to the assembly with the result that a bond is formed between the spacer member and composite and between the layers of the composite.

8 Claims, 3 Drawing Figures

LAMINATED MEMBRANE SWITCH

SUMMARY OF THE INVENTION

The present invention relates to membrane switches and in particular to a reliable inexpensive means for manufacture of such a switch.

One purpose of the present invention is a method of manufacturing a membrane switch which provides substantial economies in both material and labor.

Another purpose is an assembly for manufacture of a membrane switch, which assembly eliminates the use of conventional adhesive on the surfaces of the spacer.

Another purpose is a reliable method of forming a membrane switch which eliminates conventional adhesive as the means for bonding the switch into a single unit.

Another purpose is a method of manufacturing a membrane switch which eliminates the handling of materials having adhesive layers thereon.

Other purposes will appear in the ensuing specification, drawings and claims.

DESCRIPTION OF THE PREFERRED EMBODIMENT

Figure 1:
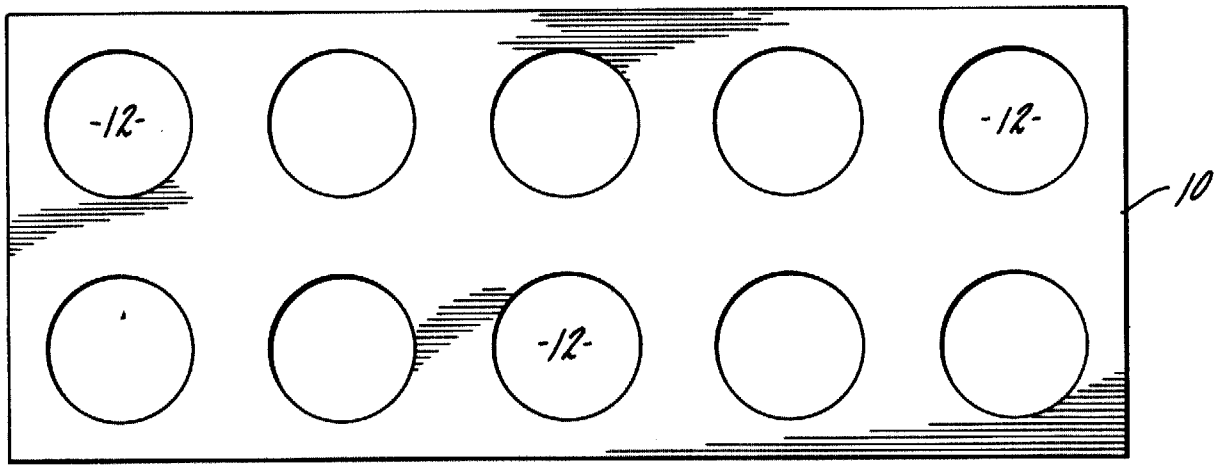
Figure 2:
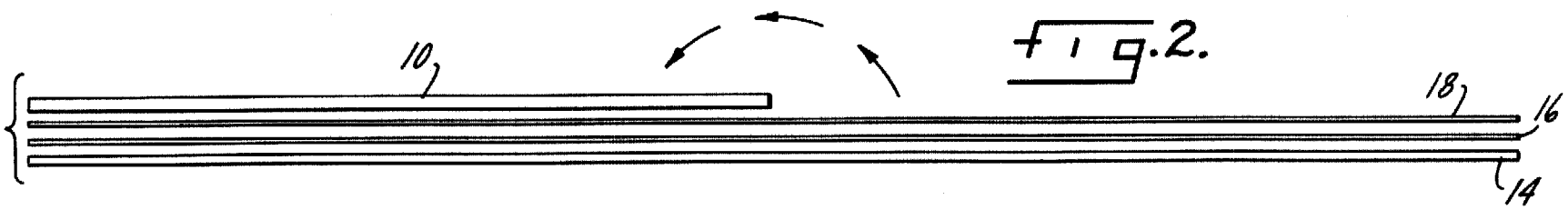
Figure 3:
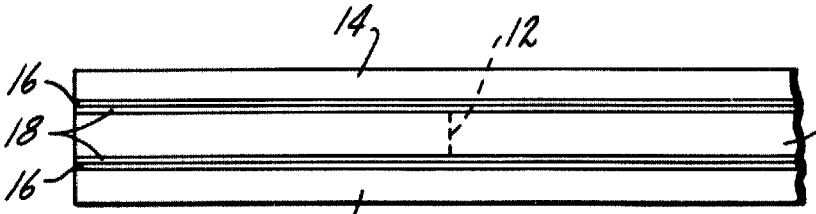

The invention is illustrated diagrammatically in the following drawings wherein:

FIG. 1 is a top plan view of the spacer member used in the membrane switch construction disclosed herein, FIG. 2 is an exploded side view showing the various layers of the membrane switch, and FIG. 3 is an enlarged fragmentary side view of a composite membrane switch after assembly.

DESCRIPTION OF THE PREFERRED EMBODIMENT

There are various currently-used methods for manufacturing membrane switches of the type generally shown in my prior U.S. Pat. Nos. 3,988,551 and 4,017,697, as well as similar patents relating to the same subject matter. Generally, a membrane switch of the type described is formed by utilizing a sheet of a polyester material and silkscreening suitable metallic conductors, preferably silver, along one surface of the sheet. An apertured spacer member having pressure sensitive adhesive surfaces is placed upon the polyester sheet which is then folded upon itself. The sandwich is held together by the pressure sensitive adhesive on the spacer.

The pressure sensitive adhesive spacer costs in the area of $0.30 per sq. ft. due to the coating operation and the necessity for release liners. In addition, since the spacer must be blanked or punched in order to form the necessary apertures therein, there is some difficulty in appropriately handling the spacer with the adhesive layer. The present invention eliminates adhesive on the spacer and utilizes the characteristics of certain types of films and the inherent ability of such films to be bonded together under suitable heat and pressure. It is possible to provide savings of approximately $0.16 per sq. ft. by elimination of the adhesive coated spacer and by the economies realized in handling spacers without adhesive coating thereon.

The spacer 10 is indicated in FIG. 1 and has a series of spaced apertures or openings 12 which are customarily formed in the spacer of a membrane switch to enable the conductors on the substrate and membrane to be placed in electrical and mechanical contact with each other. In the present instance the spacer is formed of a polyester material and may have a thickness slightly greater than 5 mils, although the invention should not be limited to any particular thickness.

In FIG. 2, which illustrates the assembly for forming a switch before folding and lamination, there are shown first and second layers, indicated at 14 and 16, which together form a composite which when folded upon itself will form the membrane and substrate as those terms are used in membrane switch technology. Layer 14 may be formed of a polyester material having a thickness of approximately 5 mils and layer 16 may be formed of a polyethylene material or other suitable plastic material having a thickness of approximately 1 mil. The polyester can be coated with the polyethylene by an extrusion process. Metallic conductors, preferably silver, illustrated diagrammatically at 18, will be painted, silkscreened or otherwise formed upon polyethylene layer 16. The conductors will be applied in such a manner that when the composite is folded upon itself they will form the spaced conductors of the two halves of the membrane switch.

In typical membrane switch construction, one or both of the substrate and membrane may be flexible. As shown herein, both are flexible as both are formed from the same composite. However, this is not necessary and there may be variations whereby only one of the membrane or substrate will be flexible.

In assembly, after the layers 14 and 16 have been formed upon each other and the metallic conductors have been suitably applied, the spacer 10 is positioned in the manner shown in FIG. 2 and the sandwich is folded upon itself so that layer 14 forms the outer surface of both the substrate and membrane and layer 16 with the metallic conductors applied thereto is directly adjacent the opposite sides of spacer 10. There is no adhesive on spacer 10. The sandwich is then placed in a suitable laminating machine and heat and pressure in appropriate amounts are applied. Suitable laminating temperatures range between 45° C. and 230° C. with a normal temperature being about 100° C. The polyethylene layer 16 and the polyester spacer 10 will thereupon be bonded together to provide a completely assembled membrane switch construction. No adhesive is utilized and the bonding that takes place in the laminating step not only secures spacer 10 to polyethylene layer 16, but also secures polyethylene layer 16 to the outer polyester material 14.

FIG. 3 is a fragmentary side view of a completed switch illustrating a portion of the switch adjacent one of the openings 12.

Of particular importance is the fact that there is no adhesive, which provides not only economies due to the absence of the adhesive and the release liners therefor, but also provides labor saving economies in the handling of the spacer.

The switch formed in the manner described is securely held together by the application of heat and pressure in the laminating process and the inherent qualities of the polyester and polyethylene material provide the necessary bonding strength.

Whereas the preferred form of the invention has been shown and described herein, it should be realized that there may be many modifications, substitutions and alterations thereto.

The embodiments of the invention in which an exclusive property or privilege is claimed are defined as follows:

1. An assembly comprising a membrane switch including a composite of first and second layers which are substantially coextensive and are made of materials which are heat-bondable to each other, the composite being folded back upon said second layer and forming the outer members of said membrane switch, electrical conductors formed on the composite, and a spacer member made of material which is heat-bondable to said second layer, said spacer member having spaced openings therein and extending between the folded portions of the composite, said composite being heat and pressure bonded to the spacer.

2. The assembly of claim 1 further characterized in that said first and second layers are formed of polyester and polyethylene.

3. The assembly of claim 2 further characterized in that said polyester has a thickness of approximately 5 mils and said polyethylene has a thickness of approximately 1 mil, with the electrical conductors being formed upon said polyethylene.

4. The assembly of claims 2 or 3 further characterized in that said spacer member is formed of a polyester material having no adhesive upon either exterior surface.

5. The assembly of claims 2 or 3 further characterized in that said electrical conductors are formed of silver.

6. A method of forming a membrane switch including the steps of:

(a) forming a composite of first and second layers of sheet material, with the composite having a size and shape to form both outer members of a membrane switch, (b) applying metallic conductors to said second layer of sheet material, (c) positioning an apertured polyester spacer upon one half of said composite, (d) folding said composite upon itself to form a membrane switch sandwich with the spacer being positioned intermediate the folded halves of the composite, and (e) applying suitable heat and pressure to said sandwich to bond the first and second layers of sheet material.

7. The method of claim 6 further characterized in that said first layer is approximately five times as thick as the second layer and said metallic conductors are formed of silver.

8. The method of claim 6 or 7 further characterized in that said first layer is formed of polyester and said second layer is formed of polyethylene.

* * * * *